United States Patent [19]

Mugler

[11] 4,115,257

[45] Sep. 19, 1978

[54] GRAIN CLEANER

[75] Inventor: Leon B. Mugler, Clay Center, Kans.

[73] Assignee: Royal Industries, Inc., Pasadena, Calif.

[21] Appl. No.: 838,831

[22] Filed: Oct. 3, 1977

[51] Int. Cl.[2] ..... B07B 1/22

[52] U.S. Cl. ..... 209/291; 209/267; 209/420

[58] Field of Search ..... 209/289–291, 209/420, 421, 267, 287, 288

[56] References Cited

U.S. PATENT DOCUMENTS

| | | | |
|---|---|---|---|
| 57,002 | 8/1866 | Smith | 209/291 |
| 182,693 | 9/1876 | Neuerburg | 209/290 |
| 346,326 | 7/1886 | Shook | 209/290 X |
| 513,973 | 2/1894 | Aulmann | 209/291 |
| 772,331 | 10/1904 | Baxter | 209/291 X |
| 1,454,071 | 5/1923 | Owens | 209/290 X |

*Primary Examiner*—Frank W. Lutter
*Assistant Examiner*—Ralph J. Hill
*Attorney, Agent, or Firm*—Edward J. DaRin, Inc.

[57] ABSTRACT

A cleaner for removing waste particles from grain and similar agricultural products. The cleaner comprises a pair of concentric drums adapted to be rotated in unison and having perforated outer surfaces for separating out waste particles. The inner drum has a plurality of sections of decreasing diameter for deterring the flow of the grain therethrough while separating out the waste particles.

13 Claims, 5 Drawing Figures

MATERIAL WITH LARGE PARTICLES (PARTIALLY CLEANED)

10
O
I
50
51
55
55I
51I
21
R
20B
UNCLEANED MATERIAL
17
20
5PI
4
22
23
A
LARGE PARTICLE WASTE
19
27
SMALL (FINES) PARTICLE WASTE
CLEAN MATERIAL
18
26
13
16
SMALL (FINES) PARTICLE WASTE 5
25
21
21P
23
22

27
25
24
21
23
22
21P

GRAIN CLEANER

PRIOR ART AND SUMMARY OF THE INVENTION

This invention relates to a grain cleaner for cleaning grain such as corn, seeds and similar agricultural products.

Cleaning agricultural products such as grain has been found to be very desirable. Specifically, as to corn it is desirable to clean corn for various reasons. Corn as it comes from the field includes large quantities of "fines", small waste particles or materials and large particle waste materials and both types contain large amounts of moisture. The moisture may comprise 25–30 percent of the weight of the waste materials. Cleaned corn can be dried in less time if the waste materials are removed before the drying procedure.

If the grain is placed directly in a storage bin when it comes in from the field to be dried or aerated, the fine waste materials may obstruct the flow of air through the storage bin and spoil the grain. Other reasons for cleaning the grain include the fact that grain is bought and sold by weight and uncleaned grain will bring a much lower price than the same weight of cleaned grain. A grain merchant will generally deduct from the weight of uncleaned grain considerably more than the weight of the waste materials included therein. The waste removed during a cleaning process can be salvaged and used for feeding livestock. Therefore, from all aspects it makes good economical sense to clean the grain.

For agricultural products, rotary cleaning screened apparatus have been developed and used for cleaning grain. Some prior art types of grain cleaners have been developed, manufactured and sold by the Hutchinson Division of Royal Industries, Inc. of Clay Center, Kans. The known prior art grain cleaners employ one or two rotary drums for separating out the waste materials from the grain. The prior art types of single rotary drum grain cleaners were only capable of removing the fines or small waste particles from the grain. Double drum cleaning apparatus have been developed for removing both fine and course waste materials. Such a prior art structure employed a spiral flight retarder within the center drum. Apparatus for cleaning various products outside of the agricultural field by means of rotary screens and the like are also known in the prior art. Typical examples of such prior art apparatus are found in U.S. Pat. Nos. 57,002; 182,693; 211,893; 346,326; 772,331; 2,274,891 and 2,543,898. There is a need, however, for grain cleaners having relatively higher cleaning rates and capabilities without sacrificing the quality of the cleaning of the grain or similar agricultural products.

The present invention provides an improved method and apparatus for cleaning grain by means of rotary screening devices. The method and apparatus of the present invention permits higher production rates due to the novel and improved structural organization for a grain cleaner. The method and apparatus for the present invention has a greater cleaning capacity with a smaller outer cleaning drum than prior art cleaners and is capable of removing both large and small waste particles from the grain.

From a method standpoint, the present invention comprehends a method for mechanically separating foreign material from grain or the like including providing a pair of concentric open-ended drums coupled together and adapted to be rotated in unison. The interior drum is constructed and defined with sections of decreasing diameters from the grain intake end to the grain discharge end. Each drum has a preselected surface defined as a perforated or screened outer cylindrical surface with the perforations of the interior drum having perforations selected relative to the particular grain to be cleaned for permitting the grain to pass through as quickly as possible along with any relatively small foreign material included therewith. The method includes arranging the drum in an angular relationship for causing the grain charged into the drums to move by gravity from the grain charging end to the opposite or discharging end. The drums are for causing the grain to be conveyed from end to end and cleaned while the drums are rotated in unison. The decreasing diameters for the interior rotating drum are selected to provide a deterrent or retarding effect on the conveyance of the grain to be cleaned as it moves therethrough and yet permits the larger particles of foreign material to be conveyed therethrough. The procedure includes discharging the clean grain from the discharge end of the outer drum.

From an apparatus standpoint, the grain cleaner comprises a cylindrical cleaning drum having open ends and a plurality of sections of decreasing diameter from one end of the drum to the opposite end. The drum is constructed and defined to have preselected cylindrical surfaces defined with perforations from one end to the preselected distance from the opposite end and the apertures of the perforated outer surface being selected relative to the size of the grain to be cleaned for permitting the grain to readily pass through the apertures while preventing the large foreign particles from passing through. The apparatus includes another cylindrical cleaning drum having open ends and a diameter larger than the first mentioned drums and arranged outside of the said drum in a concentric relationship. The two drums are coupled together for permitting rotation of the drums in unison. The outer cleaning drum is also provided with a perforated outer surface from one end to the opposite end. The apertures for the perforated outer surface are selected relative to the size of the grain to be cleaned for preventing the grain from readily passing through the apertures while permitting the relatively small foreign particles to pass through. The apparatus includes means for rotating the coupled drums in unison at a preselected speed. The apparatus includes means for charging the grain to be cleaned into the inner cleaning drum at the larger diameter end and means for discharging the cleaned grain from the outer cleaning drum adjacent the end of the apparatus opposite the end from which it was charged into the interior cleaning drum.

These and other features of the present invention may be more fully appreciated when considered in the light of the following specification and drawings, in which.

Figure 1:
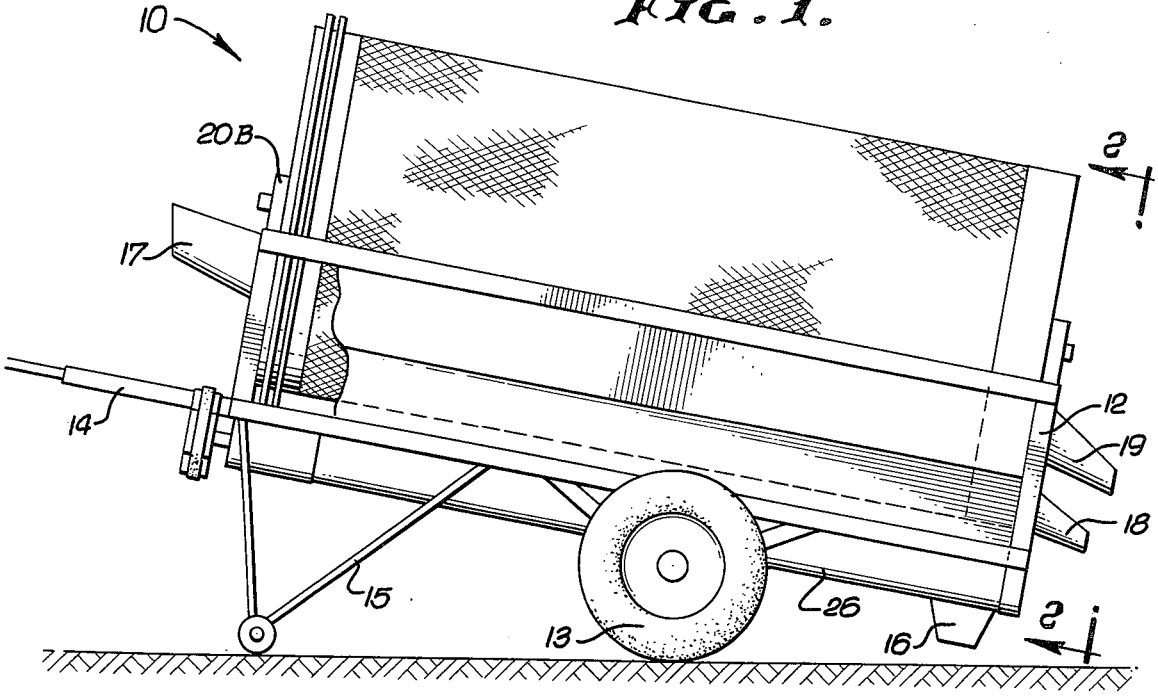
FIG. 1 is a side elevational view, with a portion broken away, of the grain cleaner embodying the present invention.
Figure 2:
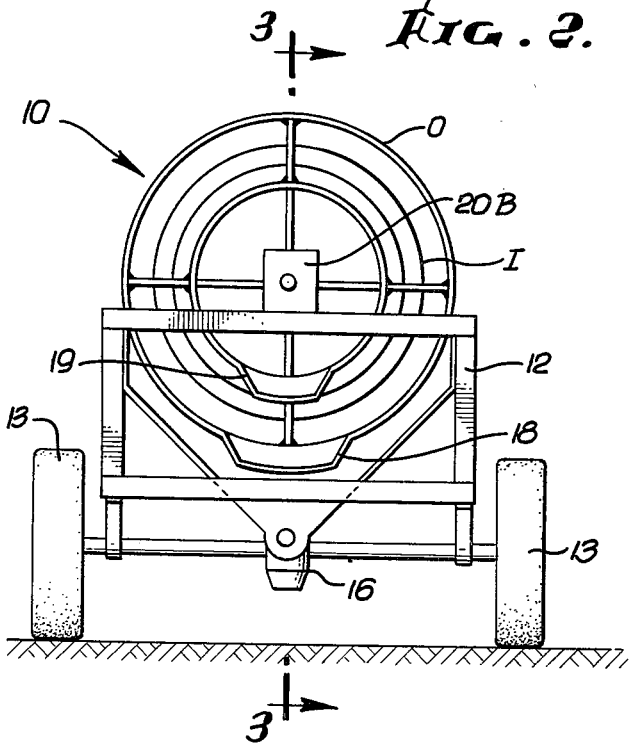
FIG. 2 is an end elevational view of the discharge end of the grain cleaner taken along the line 2—2 of FIG. 1.

Now referring to the drawings, the grain cleaner 10 embodying the present invention will be described in detail. The grain cleaner 10, as illustrated in the drawing, is constructed and defined on a supporting structure for rendering it mobile. For this purpose the grain cleaner 10 is mounted on a supporting structure 12 which may be provided with wheels for mounting rubber tires 13 for permitting the grain cleaner to be readily moved from location to location. The grain cleaner 10 may be adapted to be towed and for this purpose may include a built-in hitch 14. The supporting structure 12 may include a mechanical system for adjusting the angular elevation of the grain cleaner 10 for permitting the gravity flow of the material being cleaned through the cleaner. The mechanical system for adjusting the angular elevation of the grain cleaner 10 is identified in FIG. 1 by the reference numeral 15. The system 15 may be retracted for transporting purposes.

The basic construction of the grain cleaner 10 comprises a pair of concentric drums O and I mounted on the support structure 12. The smaller diameter drum is arranged inside the larger drum O and the two drums are mechanically coupled together to rotate in unison. Each drum O and I is provided with a perforated or screened outside cylindrical surface. The grain cleaner 10 includes an auger system A for receiving and conveying the small waste particles, or the "fines", included with the grain, to a discharge spout 16. The uncleaned material is introduced into the cleaner at a material inlet 17 and the cleaned material or grain is discharged at the opposite end of the cleaner by means of the clean material discharge spout 18. The larger waste material that is separated out from the grain as it is cleaned is discharged from a spout 19 spaced adjacent the spout 18 and upwardly thereof as illustrated.

Figure 3:
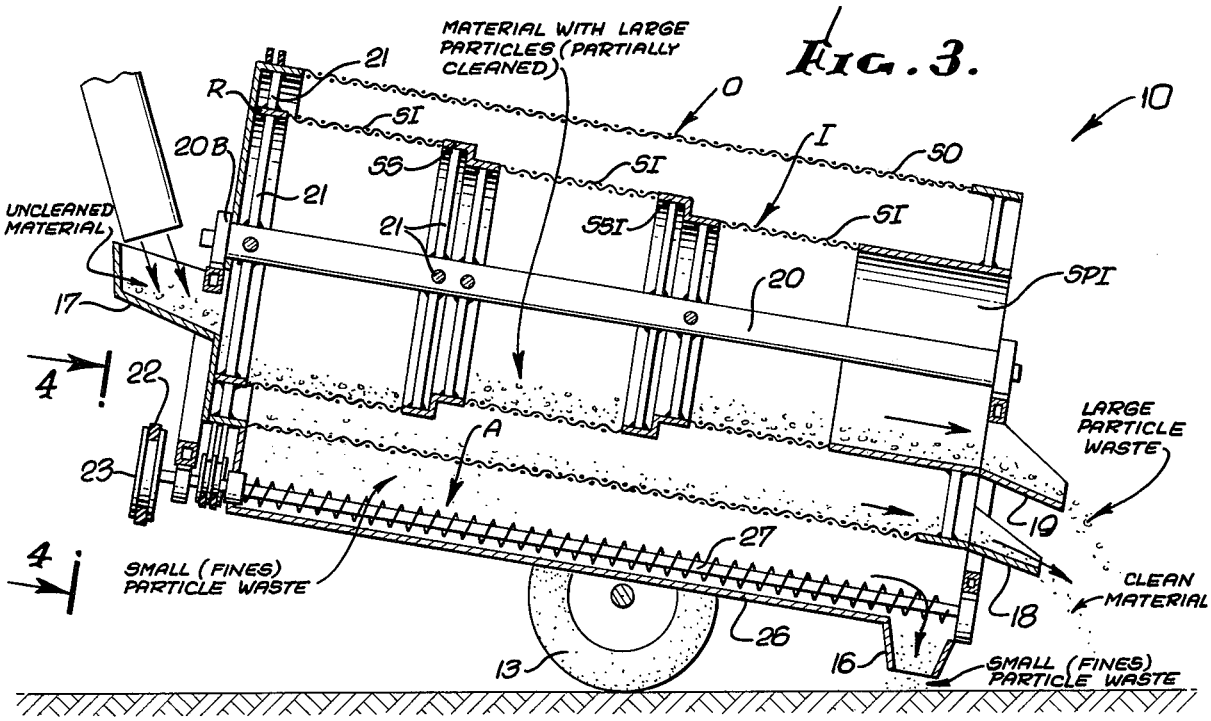
FIG. 3 is a longitudinal sectional view taken along the line 3—3 of FIG. 2 and diagrammatically illustrating the material undergoing cleaning as it progresses through the cleaner.
Figure 4:
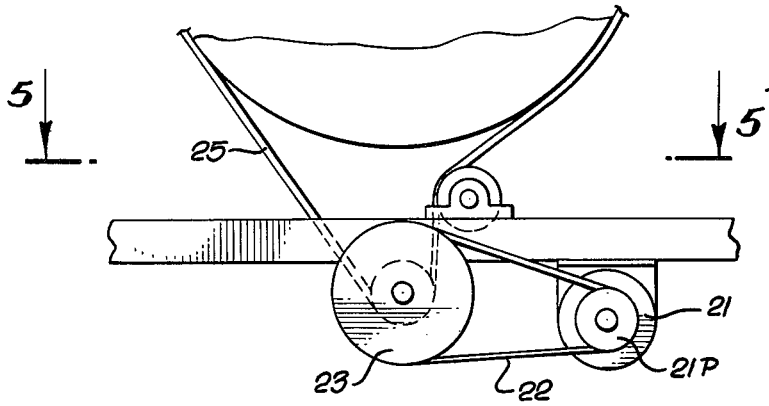
FIG. 4 is a partial side elevational view of the drum drive means taken along the line 4—4 of FIG. 3.

An important feature of the present invention is the construction of the interior cleaning drum I. The inner drum I receives the uncleaned material through the inlet 17 and discharges the large waste particles through the discharge spout 19. The drum I is defined with preselected areas having perforations on the outside surface, illustrated as the screen SI. The diameter of the drum I is decreased longitudinally from the diameter at the input spout 17 to the discharge spout 19. The diameter of the drum I is reduced in steps from one end to the other to produce a retarding effect to the flow of the material being cleaned but yet permitting the large particle waste to be conveyed therethrough; see FIG. 3. The size of the openings or the perforations in the screen SI is selected to allow the grain to be cleaned to pass through as quickly as possible and carry the fine particle material with it. The openings in the screen SI are also proportioned to prevent the large waste particles from passing through the outer drum O. The drum I, as illustrated in FIG. 3, in particular, has three sections of different diameters or two steps of reduced diameter from the input end to the output end. The first step is identified by the difference in diameter between the input or left-hand section of the drum I and the central section as the step SS and the step defined between the center section and the discharge section is identified as the step SSI. Stepped rings SS and SSI couple the adjacent sections of the drum I. In one practical embodiment of the invention, the length of the first two sections of the drum I may be three feet long and the terminal section being four feet in length. The terminal section of the drum may be subdivided so that the outside cylindrical surface has a two-foot length of screening with a solid portion SPI extending from the terminal end of the drum to approximately two feet inwardly, as best illustrated in FIG. 3.

The outer drum O is also provided with a cylindrical wall having perforations or screening thereon, and which screening is identified by the reference letters SO. The apertures for the outer wall 0 are selected so that the grain will not fall through the screening but will permit the fine waste particles to fall through. The cleaned grain falling through from the inner drum I will be conveyed towards the cleaned material discharge spout 18. It will also be noted that as a result of the decreasing diameters or steps provided for the inner drum I that the volumes defined between the inner and outer drums increase in travelling from the left to the right. The increase in volumes between the drums accommodates the increasing volumes of grain conveyed through the cleaner 10. The inner drum I and the outer drum O are rigidly coupled together to a central shaft 20 so as to permit the drums to be rotated in unison. The shaft 20 is mounted to support bearings 20B. The drums are secured together through the provision of securing elements R, SS and SS1 spaced along the length of the drums and are coupled together by means of rigid posts such as posts 21. The posts 21 are secured between the central shaft 20 and the securing elements of the inner drum I and between the securing elements of the inner drum I and the securing elements of the outer drum O. The central shaft 20 is driven by means of a single drive motor 21. The shaft of the motor is provided with a pulley 21P that is coupled by means of a drive belt 22 to a larger diameter pulley 23 mounted on the end of a drive shaft 24. The drive shaft 24 is coupled to the central shaft 20 by means of a belt 25.

Figure 5:
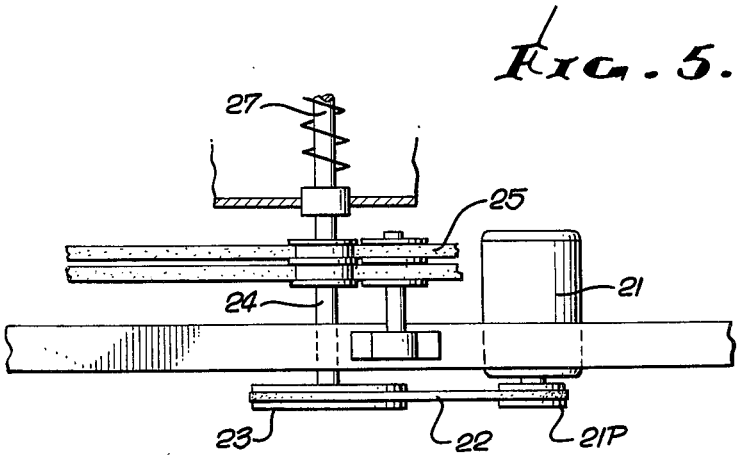
FIG. 5 is a top plan view taken along the line 5—5 of FIG. 4.

The auger system A of the cleaner 10 includes a small waste particle collecting hopper 26 having an auger 27 arranged therein and extending substantially the entire length of the cleaner 10. The auger 27 is also driven by means of the motor 21 through the drive shaft 24; see FIG. 5.

With the above structure in mind and with reference to FIG. 3 wherein the path of the material through the cleaner 10 is illustrated, the operation of the grain cleaner will be described. It is assumed that the motor 21 has been energized and the drums are rotating in the below discussion. The uncleaned material or grain is deposited into the input spout 17 of the cleaner so as to enter the first section of the inner drum I. The grain deposited into the inner drum I falls through the screening SI onto the screen SO for the outer drum O. With the rotation of the drums O and I, the uncleaned material will travel from left to right through the various sections of the inner drum I. In the first stage between the input section and the center section of the drum I, a large portion of the grain falls through the screening SI to the center drum O along with the small waste particles that fall through the screening. The remaining portion of the material or the partially cleaned material will travel into the central section of the inner drum I by means of the first step SSI. In this section more of the grain falls through the screening SI to fall into the outer drum O. The large waste material will continue to travel beyond the second step SSI and into the output section of the inner drum I. As illustrated in FIG. 3, any grain that travels into the third section will pass into the outer drum O freed of the large waste material and which large particle waste travels the complete length of the drum to be discharged at the spout 19. During the time that the large particles of waste material are traveling through the inner drum I, the grain that has been deposited into the outer drum O will travel the length thereof and is retrieved at the clean material spout 18. Similarly, the fine material will pass through the screening SO for the outer drum O onto the auger 27 and be conveyed to the discharge spout 16.

This type of drum cleaning action has been found to permit the rapid cleaning of the grain with a minimum amount of effort and with a smaller outside diameter for the outer drum O than heretofore thought possible and at a much more rapid rate.

What is claimed is:

1. A cleaner for grain or the like comprising a normally inclined cylindrical cleaning drum having open ends and a plurality of sections of decreasing diameter from the upper end of the drum to the opposite end of the drum, the drum having preselected cylindrical surfaces defined with perforations from the upper end thereof to a preselected distance from the opposite end, the apertures of the perforated surfaces being selected and defined relative to the grain or the like to be cleaned for permitting the grain to readily pass through the apertures while preventing large foreign particles from passing therethrough, another cylindrical cleaning drum having open ends and a diameter larger than the first-mentioned drum and arranged outside of said first drum in a concentric relationship therewith, means for coupling the drums together for rotation in unison, said another cleaning drum having a perforated surface from one end thereof to the opposite end, the apertures of the surface being selected and defined relative to the grain or the like to be cleaned for preventing the grain or the like from readily passing through the apertures while permitting relatively small foreign particles to pass therethrough, means for rotating the cleaning drums in unison at a preselected speed, means for charging the grain or the like to be cleaned into the inner cleaning drum at the larger diameter end thereof, and means for discharging the cleaned grain or the like from the outer cleaning drum adjacent the opposite end from which it was charged into the inner cleaning drum.

2. A cleaner for grain or the like as defined in claim 1 including means for adjusting the horizontal slope of the cleaner from the intake end to the discharge end for causing the grain or the like to gravity flow therethrough as the cleaning drums are rotated.

3. A cleaner for grain or the like as defined in claim 2 including means for discharging the large foreign particles from the inner cleaning drum adjacent the smallest diameter end thereof, and means for conveying and discharging the the small foreign particles passing through the outer cleaning drum from the intake end to the discharge end adjacent the discharge end.

4. A cleaner for grain or the like as defined in claim 3 wherein said means for conveying the small foreign particles comprises an auger.

5. A cleaner for grain or the like as defined in claim 4 including means coupled to said drum rotating means for driving said auger at a preselected reduced speed from the rotary speed for the cleaning drums.

6. A cleaner for grain or the like as defined in claim 2 wherein the smallest diameter section of the inner cleaning drum has a solid portion adjacent the discharge end and the remaining portion is perforated.

7. A cleaner for grain or the like as defined in claim 6 wherein the perforated surfaces of the pair of cleaning drums comprise screens.

8. A cleaner for grain or the like as defined in claim 1 wherein the inner cleaning drum has solid sections connecting the plurality of sections of different diameters for providing a step-like effect longitudinally of the drum to deter the grain from flowing therethrough but not preventing the large foreign particles from continuing through the drum to the opposite end thereof to be discharged therefrom.

9. A cleaner for grain or the like as defined in claim 8 wherein the successive diameters of the inner cleaning drum are selected relative to the volume of grain or the like flowing through the various cleaning sections for permitting sufficient grain capacity between the cleaning drums as the cleaned grain or the like moves from one end to the opposite end of the outer cleaning drum in addition to being selected for providing the desired grain deterent effect.

10. A cleaner for grain or the like as defined in claim 1 wherein the first two sections of the inner cleaning drum from the intake end thereof are approximately of the same length.

11. A method for mechanically separating foreign material from grain or the like including the steps of providing a pair of concentric, open-ended cylindrical drums coupled together and adapted to be rotated in unison, the inner drum being constructed and defined with sections of decreasing diameter from the grain intake end to the grain discharge end, each drum having preselected surfaces defined as perforated cylindrical surfaces with the inner drum having perforations selected relative to the grain to be cleaned for the grain to pass therethrough as quickly as possible, along with any relatively small foreign material included therewith, arranging the drums in an angular relationship for causing the grain charged into the drums to move by gravity from the grain charging end to the opposite end, rotating the drums in unison for causing the grain or the like to be conveyed from end to end, charging the inner rotating drum at the grain intake end with the grain to be cleaned to cause it to travel from the intake end longitudinally of the pair of drums to the opposite end of the outer drum when the drums are rotating and have been arranged at said angular relationship to be discharged from the outer drum, the decreasing diameters for the inner rotating drum being selected for providing a deterent effect on the conveyance of the grain to be cleaned as it moves therethrough and yet selected so as to not permit the large particles of foreign material to be conveyed therethrough, the perforations for the outer drum being selected for permitting any small foreign particles to be passed therethrough but not permitting the grain to pass through, and discharging the cleaned grain from adjacent the discharge end of the outer drum.

12. A method for mechanically separating foreign material from grain or the like as defined in claim 11 including the steps of discharging the large foreign particles from the inner drum adjacent the discharge end thereof, and discharging the small foreign particles passing through the outer drum.

13. A method for mechanically separating foreign material from grain or the like as defined in claim 12 wherein the steps of discharging the small foreign particles comprises collecting the small foreign particles and conveying them towards the discharge end of the outer drum and then discharging them adjacent the discharge end of the outer drum.

* * * * *